US009630414B2

(12) United States Patent
Reiniger

(10) Patent No.: US 9,630,414 B2
(45) Date of Patent: Apr. 25, 2017

(54) PRINTING SYSTEM AND PRINTING DEVICE FOR BOTTLES OR CONTAINERS HAVING A MULTI-PART SUPPLY TANK AND METHOD

(71) Applicant: KHS GmbH, Dortmund (DE)

(72) Inventor: Markus Reiniger, Mönchengladbach (DE)

(73) Assignee: KHS GmbH, Dortmund (DE)

( * ) Notice: Subject to any disclaimer, the term of this patent is extended or adjusted under 35 U.S.C. 154(b) by 0 days.

(21) Appl. No.: 14/917,990

(22) PCT Filed: Aug. 20, 2014

(86) PCT No.: PCT/EP2014/067784

§ 371 (c)(1),
(2) Date: Mar. 10, 2016

(87) PCT Pub. No.: WO2015/036215

PCT Pub. Date: Mar. 19, 2015

(65) Prior Publication Data

US 2016/0221346 A1 Aug. 4, 2016

(30) Foreign Application Priority Data

Sep. 13, 2013 (DE) ..... 10 2013 110 108

(51) Int. Cl.
*B41J 2/175* (2006.01)
*B41J 3/407* (2006.01)
*B41J 2/18* (2006.01)

(52) U.S. Cl.
CPC ..... *B41J 2/175* (2013.01); *B41J 2/17513* (2013.01); *B41J 2/18* (2013.01); *B41J 3/4073* (2013.01)

(58) Field of Classification Search
CPC .... B41J 2/175; B41J 2/17509; B41J 2/17513; B41J 2/17596; B41J 2/18; B41J 3/4073
See application file for complete search history.

(56) References Cited

U.S. PATENT DOCUMENTS 5,193,456 A * 3/1993 Wolfe ..... B41F 17/22 101/247
6,684,770 B2 * 2/2004 Kamen ..... B41F 15/0872 101/119
8,288,700 B2 * 10/2012 Bathelet ..... B23K 26/0838 250/201.2
8,994,959 B2 * 3/2015 Beckhaus ..... B41F 17/18 356/138
9,032,872 B2 * 5/2015 Uptergrove ..... B41J 3/4073 101/35
2011/0285768 A1 11/2011 Preckel
2012/0255450 A1 10/2012 Till

* cited by examiner

*Primary Examiner* — Anh T. N. Vo
(74) *Attorney, Agent, or Firm* — Occhiuti & Rohlicek LLP

(57) ABSTRACT

A printing system includes a printing station having a digital ink-jet print head disposed on a subsystem that moves along a transport path for the containers. A tank for holding ink is part of a static subsystem that is not entrained with the print head. The tank has a static tank-part and a moving tank-part, the latter being entrained by the moving subsystem.

21 Claims, 13 Drawing Sheets

PRINTING SYSTEM AND PRINTING DEVICE FOR BOTTLES OR CONTAINERS HAVING A MULTI-PART SUPPLY TANK AND METHOD

RELATED APPLICATIONS

This is the national stage under 35 USC 371 of international application PCT/EP2014/067784, filed on Aug. 20, 2014, which claims the benefit of the Sep. 13, 2013 priority date of German application DE 10 2013 110 108.9, the contents of which are incorporated herein by reference.

FIELD OF INVENTION

The invention relates to a printing system for printing on containers, and in particular, to management of ink in such a printing system.

BACKGROUND

It is generally known to print on containers using an inkjet print head. These print heads are typically placed on the periphery of a rotor that prints as the containers are moving.

A difficulty that arises is that of keeping these print heads supplied with ink even though they are moving. Known solutions involve large numbers of ink-carrying pipes and rotary couplings. These represent significant plant complexity. Moreover, in known printing systems, a centered arrangement of the rotary couplings in the region of the rotary axis is not possible.

SUMMARY

In one aspect, the invention features a printing system for printing on bottles or on similar containers. The printing system includes a rotating subsystem. At least one electric or electronic inkjet print head for printing one a container is arranged at a printing station on this rotating subsystem so that moves along a container transport path. The printing system also includes a static subsystem that is not entrained with the print head. This static subsystem has at least one tank, which is referred to hereinafter as the "main tank." The main tank defines a holding space to hold printing color or printing ink, hereafter referred to simply as "ink." This ink is to be supplied to the print head. A problem that arises is that of coupling the static subsystem and the rotating subsystem so that ink can move from the holding space to the moving print head. To solve this problem, the tank has first and second tank-parts. The first tank-part is statically arranged and the second tank-part is configured to be moveable with the moving subsystem. This arrangement couples the static subsystem and the moving subsystem with reduced plant complexity.

In some embodiments, the first tank-part is a lower tank-part that forms a holding space for the ink that is to be stored. The holding space is therefore static. This means that the ink within it is not subject to any motion-related forces, and in particular, to centrifugal force.

In some embodiments, the second tank-part is an upper tank-part that closes off the first tank-part. This results in a sealed tank whose holding space is closed off from the exterior. Among these embodiments are those in which second tank-part is configured as a cover that seals the first tank-part.

In some embodiments, the first and second tank-parts connect to one another in a fluid-tight manner. As a result, even if there is relative motion between the first and second tank-parts, the tank effectively prevents a loss of ink and ingress of foreign bodies into the tank's holding space. The seal between the first and second tank-parts can be configured as a ring seal, as an O-ring, or as a sliding seal containing, for example, graphite, or ceramics.

Alternatively the seal can be a gap seal, such as a fluid-filled gap seal. A gap seal offers the advantage of a reduced coefficient of friction compared with the aforesaid types of seal.

Among the embodiments are those in which the interior of the tank is configured so that it can be filled with an inert gas. This generates a flow of sealing gas through a gap formed between the first and second tank-part. This flow of sealing gas prevents ambient air entering the holding space. This has a positive effect on the longevity of the ink in the tank.

In some embodiments, the second tank-part is configured so as to be height-adjustable relative to the first tank-part. This makes it possible to position the first tank-part at a height that optimizes seal tightness of the tank and/or that optimizes the friction between the first and second tank-parts. The height-adjustability can be achieved, for example, using length-adjustable coupling elements that mechanically connect the second tank-part is to the moving subsystem.

In some embodiments, the first and/or second tank-part is ring-shaped or annular. These tank-parts define a central opening. If the tank is arranged centrally so that its median vertical axis coincides with the rotary axis of the rotating subsystem, then the opening will lie within the region of the rotary axis. This means that pipes can now be routed through the tank. It also means that a drive for driving the moving subsystem can be placed within the opening.

In some embodiments, the second tank-part includes at least one tubular pipe whose free end extends into the holding space formed by the first tank-part. Alternatively, the second tank-part includes a plurality of tubular pipes arranged at fixed angular distances from one another and whose free ends extend into the holding space formed by the first tank-part. As the moving subsystem moves, and hence as the second tank-part that is coupled to the moving subsystem moves, a partial section of the pipe moves through the ink, thus stirring it. This discourages sedimentation and/or separation and separate settling of the constituents of the printing ink.

In some embodiments, the free end of the pipe has a laterally protruding stirring section. A flat laterally protruding section that protrudes from the pipe's outer wall can form this stirring section can be formed, A plurality of such stirring sections can also be provided on one pipe. Even one such stirring section will significantly improve the stirring and/or circulating effect of the moving pipe.

Alternatively, the second tank-part comprises at least one stirring section that extends into the holding space of the first tank-part. This stirring section can be configured separately from the pipes and be, for example, arranged on the cover section of the second tank-part protruding downwards.

In some embodiments, the first tank-part includes a plurality of separate chambers for holding ink. This permits the tank to hold different inks, such as differently colored inks. Alternatively, one of these chambers could hold a cleaning fluid for cleaning the print heads.

In some embodiments, the moving subsystem includes not only a print head but also at least one auxiliary tank for the ink. In these embodiments, the print head connects to the auxiliary tank. Among these embodiments are those in which the entrained or rotating part of the printing system includes a plurality of print heads and the auxiliary tank is common to all the print heads. Some of these embodiments include a controller and/or a regulator for controlling and/or regulating the pressure and/or the level of ink in the auxiliary tank.

In another embodiment, the auxiliary tank includes a tank interior that is connected to the print head. The tank receives ink and is configured with an overflow to regulate the ink level in the tank's interior.

In another embodiment, the entrained part of the printing system includes at least two auxiliary tanks of which a first auxiliary tank serves as an in-tank for supplying the print head with ink.

In another embodiment, a second auxiliary tank is provided as an out-tank for the print head through which ink flows during the printing operation.

In another embodiment, in the case of a transport element for the print heads, which can be driven to rotate about a vertical machine axis and which is configured for example as a rotor, the auxiliary tank is centrally arranged and/or configured to be rotationally symmetrical about to the vertical machine axis.

In another embodiment, the auxiliary tank is shaped like an annulus or circular cylinder.

In another embodiment, a pipe for feeding or taking away the ink respectively to or from the auxiliary tank is disposed coaxially with the machine axis.

In another embodiment, two auxiliary tanks are used. These are offset relative to one another in the direction of the machine axis or configured such that a first auxiliary tank is enclosed by a second auxiliary tank.

In another embodiment, the moving or rotating part of the printing system is above the static part of the printing system. Alternatively, with the exception of the at least one print head, the static part of the printing system encloses the moving part of the printing system.

In another embodiment, a control system for controlling or regulating the pressure of the ink in the auxiliary tank and/or in the print head is configured to compensate for centrifugal forces arising as a result of the rotational speed of the print head and/or to compensate for forces resulting from acceleration and/or a change of direction resulting from forces acting on the ink.

In another embodiment the static part of the printing system includes a main tank for the ink and a system for topping-up the ink and/or for conditioning the ink, more particularly for temperature balancing and/or degassing and/or filtering the ink.

In another embodiment, the printing system is configured to have an ink circuit inside the static part of the printing system or of the ink supply system and/or for an ink circuit that includes the static part of the printing system as well as the moving or rotating part of the printing system.

The invention also relates to a printing device for printing bottles or similar containers. Such a printing device includes a container transporter that can be driven to rotate and that has a plurality of printing stations that are formed on the container transporter and on which the printing of the containers is carried out with at least one digital inkjet print head of a printing system. Among the embodiments of this invention are those in which printing system is configured according to one of the embodiments described above.

In some embodiments, the print heads are provided on a movable transport element, such as on a transport element that can move about a vertical machine axis.

In other embodiments, the transport element that includes the print heads is either the container transporter or a transport element independent of the container transporter.

Some embodiments feature a plurality of printing systems, each of which is associated with one color or with one color set. These embodiments are particularly well suited for producing a multicolor print on the containers.

In some embodiments, at least some of the printing systems that are associated with different colors or color sets, and their print heads, are provided on a common transport element. In other embodiments, they are on different transport elements.

Also among the embodiments of the invention are those that have at least two container transporters disposed sequentially in a transport direction of the containers. In these embodiments, each container transporter carries at least one printing system for printing the containers with one color or with one color set of a multicolor print.

In other embodiments, each printing position is configured for a relative motion between the print head and the container.

As used herein, "inert gas" refers to gases that are sluggish to react and that take part in only a few chemical reactions. Examples of inert gas include $CO_2$, $N_2$ and sterile air.

As used herein, a "pulsation damper" is a buffer element that is incorporated into pipes carrying ink and that typically comprise a holding space for the ink. These pulsation dampers can also have a diaphragm that isolates a volume of gas, such as air or nitrogen, from the holding space for the ink. Such pressure dampers are useful for compensating for pressure fluctuations in the pipes that carry the ink or in the print heads.

In another aspect, the invention features a printing system for printing on containers. Such a printing system includes a moving subsystem and a static subsystem. A digital ink jet print head is part of a printing station disposed on the moving subsystem so that it moves along a transport path for the containers. The static subsystem, however, is not entrained with the print head. A tank that is part of the static subsystem holds ink to be supplied to the print head. This tank has a static first tank-part and, as a result of its entrainment with the moving subsystem, a moving second tank-part. The first tank-part includes a lower tank-part that defines a holding space for holding the ink.

In some embodiments, the second tank-part includes an upper tank-part or a cover that closes off the first tank-part.

Other embodiments include a fluid-tight connection between the first tank-part and the second tank-part. Examples of fluid-tight connections include a ring seal, a sliding seal, a gap seal, including a fluid-filled gap seal. Some embodiments that have a gap seal include inert gas in the tank's interior. A flow of this inert gas through the gap tends to seal the gap.

In some embodiments, the second tank-part is configured to be height-adjustable relative to the first tank-part.

Other embodiments include annular tank-parts, each of which has walls defining a central opening.

Yet other embodiments include an ink pipe having a free end. The ink pipe extends through the second tank-part into a holding space formed by the first tank-part so that the ink pipe's free end is inside the holding space. Among these embodiments are those in which there is a second ink pipe that also has a free end. This second ink pipe's free end is also in the holding space. Also among these embodiments are those in which there are two holding spaces, with one ink pipe extending into each holding space.

Other embodiments include an ink pipe having a stirring section that protrudes laterally from a free end thereof. In these embodiments, the ink pipe extends through the second tank-part into a holding space formed by the first tank-part with the free end being disposed inside the holding space.

In some embodiments, the second tank-part further includes a stirring section that extends into a holding space within the first tank-part.

Also among the embodiments are those in which the first tank-part includes separate chambers, each of which is configured to separately hold a volume of ink.

Yet other embodiments have a container transporter that is driven to rotate about an axis thereof. In these embodiments, the printing station, along with a plurality of other printing stations, is formed on the container transporter. Each printing station has at least one ink jet printing head.

In another aspect, the invention features a method of using a printing system for stirring ink during printing of containers. Such a method includes causing containers to be moved by a rotationally driven container transporter having a plurality of printing stations formed thereon, each of the printing stations having an inkjet print head, holding ink in a first tank for at least a majority of the print heads, wherein the tank includes a static first tank-part and a moving second tank-part, extending a pipe through the second tank-part and into the first tank-part such that the pipe is at least partially in the ink, the pipe being connected to the second tank-part, whereby the pipe, as a result of movement imparted by connection to the second tank-part, stirs the ink.

Among these practices are those that include entraining the second tank-part with a moving printing system, and holding ink in a holding space formed in the first tank-part.

As used herein, "container" refers to cans and bottles made for example from metal, glass and/or plastic.

As used herein, "end-shooter print heads" are print heads that each have only one connection through which the ink is delivered at a given pressure, for example at a slight vacuum. The ink is continuously present at the print head and can only leave the print head through the nozzles.

As used herein, a "side-shooter print head" is a print head that has at least two connections through which ink is carried in a circuit through the print head. A cross-flow at right angles to the print head's nozzles is preferably generated in this way.

As used herein, expressions such as "essentially", "in essence," or "around" mean variations from the respective exact value by ±10%, preferably by ±5%, and/or variations in the form of changes insignificant for the function.

Further embodiments, advantages, and possible applications of the invention arise out of the following description of embodiments and out of the figures. All of the described and/or pictorially represented attributes, whether alone or in any desired combination are fundamentally the subject matter of the invention independently of their synopsis in the claims or a retroactive application thereof. The content of the claims is also made an integral part of the description.

BRIEF DESCRIPTION OF THE DRAWINGS

These and other features and advantages of the invention will be apparent from the following detailed description and the accompanying figures, in which.

DETAILED DESCRIPTION

Figure 1:
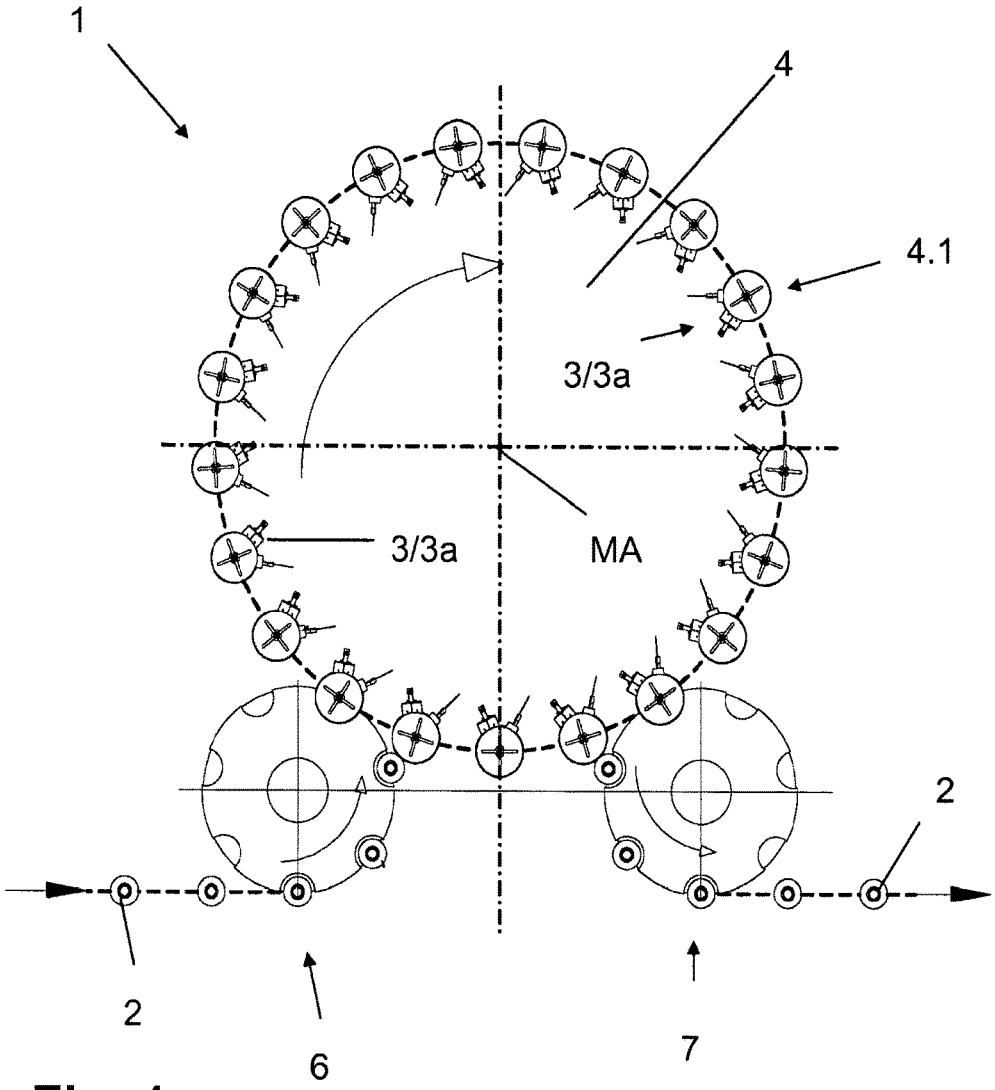
FIG. 1 shows a simplified plan view of a rotary-type printing device for printing bottles or other containers.

FIG. 1 shows a rotary-type printing device 1 for printing containers 2 using digital inkjet print heads 3. Each print head 3 includes a vertical row of nozzles 3.1, best seen in FIG. 2. The nozzles can be individually triggered by an electrical signal. Appropriate triggering of electrodes, valves, piezoelectric-elements, or similar devices causes discharge of ink at the nozzles 3.1.

Referring back to FIG. 1, the printing device 1 includes a rotor 4 that rotates, preferably continuously, about a vertical machine axis MA.

The rotor's periphery includes printing stations 4.1 formed thereon. Each printing station 4.1 has an associated print head 3 that moves together with the printing station 4.1. A container inlet 6 feeds a container 2 that is to be printed upon to printing stations 4.1. The container 2 then moves together with the print head 3 associated with that printing station. As the container moves, the print head 3 prints upon it. After having been printed upon the printed containers 2 leave the printing station 4.1 at a container outlet 7.

The printing of the containers 2 is carried out line-by-line at printing stations 4.1 through the movement of container 2 relative to print head 3. In the illustrated embodiment this is done by orienting a center-line of each container 2 parallel to the rotary axis of rotor 4 and rotating the container about the center line in a controlled manner during printing.

Figure 2:
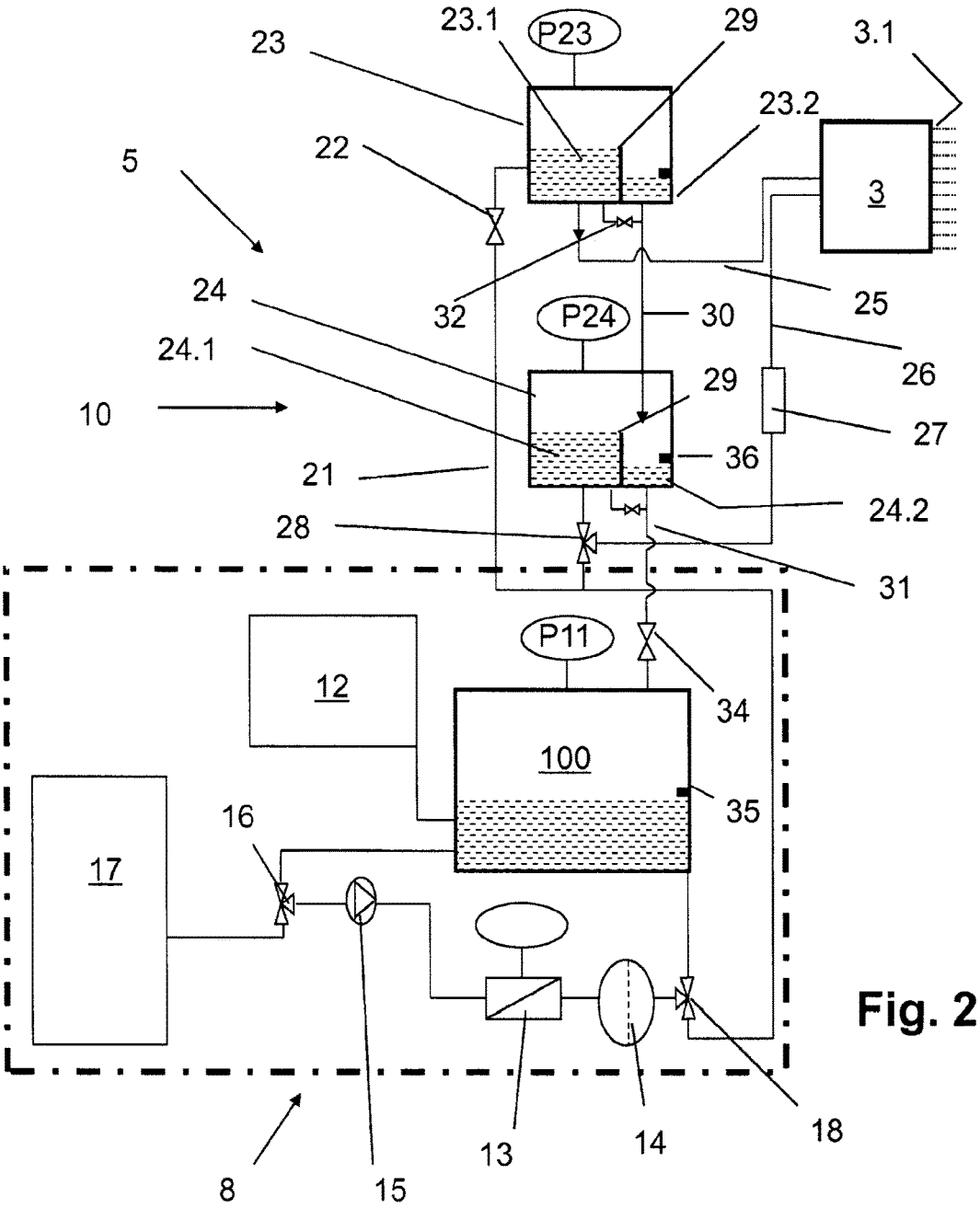
FIG. 2 shows a simplified functional view of the printing system of the printing device of FIG. 1 together with one of the print heads.
Figure 3:
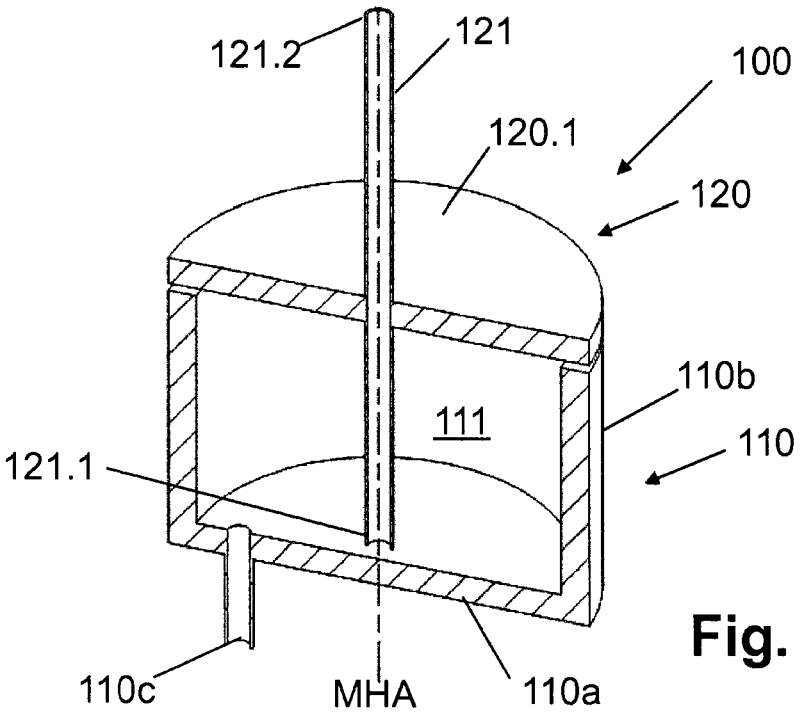
FIG. 3 shows a vertical section of the main tank of the printing system.

As shown in FIG. 2, a printing device 1 has a printing system 5 that has two subsystems: a static subsystem 8 and a moving subsystem 10. As shown in FIGS. 2 and 3, the static subsystem 8 is housed in a machine frame of the printing device 1 and does not rotate with rotor 4. The moving subsystem 10 is provided on the rotor 4 and includes the print heads 3.

The static subsystem 8 includes a circuit for ink. The circuit includes a main tank 100 to hold a supply of ink and certain functional elements for conditioning the ink. These functional elements include a temperature regulator 12, an ink degasser 13, and an ink filter 14.

The temperature regulator 12 heats or cools the ink in main tank 100 so as to keep it within a narrow temperature range. The ink filter 14 filters the ink. The ink degasser 13 removes gas from the ink. A transfer and circulating ink pump 15 circulates ink within the circuit. During printing, the main tank 100 is partially filled with ink under a controlled pressure 2100. A top-up valve 16 selectively connects an ink cartridge 17 to the main tank 100 to permit topping up of the ink in the main tank 100.

A supply line 21 connects the static subsystem 8 to the moving subsystem 10 of the printing system 5 through a supply-line valve 22 and a multi-port valve 18, the latter being positioned downstream of the ink filter 14 and upstream of the main tank 100 in the direction of flow in the ink circuit of the static subsystem 8.

FIGS. 3 to 7 show multiple embodiments of a main tank 100 that is used in the static subsystem 8. The main tank 100 is a multi-part tank having a first tank-part 110 and a second tank-part 120.

The first tank-part 110 includes a base section 110*a* and a wall section 110*b* that extends away from base section 110*a*. The first tank-part 110 is thus shaped like a bowl that is open on a side opposite its base section 110*a*. This bowl defines a holding space 111 for the ink.

A feed line 110*c* carries ink through the base section 110*a* and into the holding space 111. Although it is shown as vertical, the feed line 110*c* can be oriented in any direction. More particularly, it is possible to orient the feed line 110*c* to feed ink along a circumferential direction of a polar coordinate system defined by a median vertical axis MHA of the first tank-part 110, thus creating a circular ink flow within the holding space 111. Preferably, the first tank-part 110 is rotationally symmetrical relative to its median vertical axis MHA.

The second tank-part 120 is a cover that sits above the first tank-part 110 and engages an upper free end of the wall section 110*b* to seal off the holding space 111. A flat cover section 120.1 of the second tank-part 120 covers the holding space 111.

An ink pipe 121 passes through the second tank-part 120 and functions as a way to pass ink in or out of the main tank 100. The ink pipe 121 passes through the cover section 120.1 along the median vertical axis MHA. A lower free end 121.1 of the ink pipe 121 extends into holding space 111. Preferably, the lower free end 121.1 almost reaches the base section 110*a*. This is particularly useful when the ink pipe 121 is used to withdraw ink from the holding space 111.

The first tank-part 110 is associated with the static subsystem 8, and is thus held immobile relative to the machine frame. The second tank-part 120, on the other hand is associated with moving subsystem 10, and thus rotates with the rotor 4 upon which the print head 3 is disposed. A mechanical coupling between the second tank-part 120 and the rotor 4 transmits the motion of the rotor 4 to the second tank-part 120. The mechanical coupling can be effected by way of the ink pipe 121 or, as shown in FIG. 4, by another coupler 140.

Moving the second tank-part 120 stirs the ink in the holding space 111. To enhance this stirring action, it is useful to provide stirring sections to more efficiently couple the movement of the second tank-part 120 to ink. The ink pipe 121 can act as a stirring section. The stirring sections can also be formed by laterally protruding surfaces, such as wing-like surfaces. This stirring helps prevent sedimentation or separation of the ink and does so without the need to provide a separate stirring apparatus.

A seal at the upper free end of the wall section 110*b* forms a fluid-tight closure of the holding space 111 that remains fluid-tight even though the second tank-part 120 moves relative to first tank-part 110. A suitable seal with this property is an O-ring made from a flexible material, such as rubber. Or such a seal can be a sliding seal containing graphite or ceramics. In some embodiments, the seal is a gap seal or labyrinth seal as shown more closely in FIG. 4.

Figure 4:
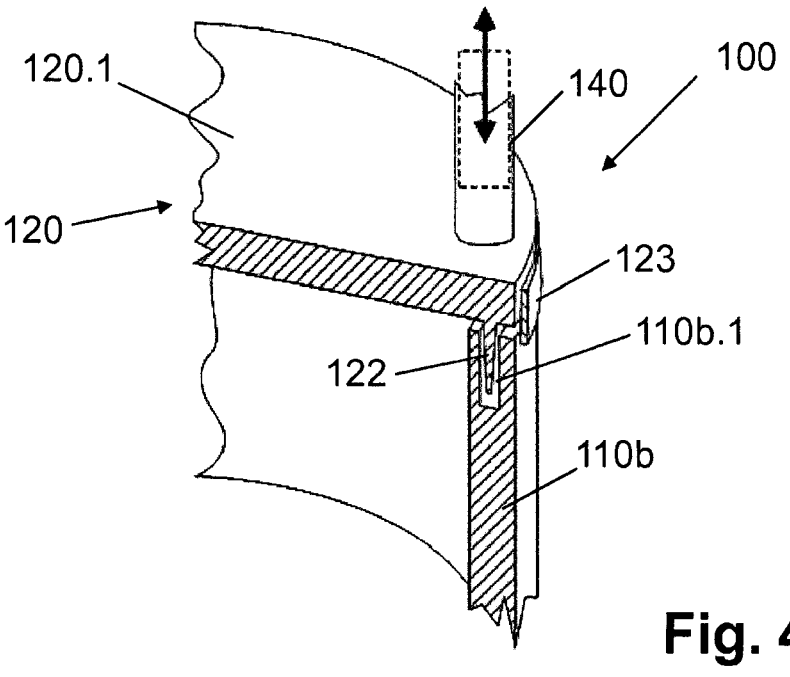
FIG. 4 shows a cutaway view of the main tank of FIG. 3 in the transitional region between the first and second tank-part.

Referring now to FIG. 4, a gap seal or labyrinth seal can be formed by providing a circumferential indentation or groove 110*b*.1 on the free end of the wall section 110*a* lying opposite the second tank-part 120. The indentation or groove 110*b*.1 extends all around the end face and defines a channel that receives a corresponding circumferential tongue 122 that protrudes from the second tank-part 120. The groove 110*b*.1 and the tongue 122 are rotationally symmetric relative to the to the median vertical axis MHA.

The thickness of the tongue 122 is less than the width of the groove 110*b*.1. As a result, when the tongue 122 engages the groove 110*b*.1, a gap remains on either side of it. This gap can preferably be filled with a sealing fluid. This sealing fluid can be a gas or a liquid. A suitable liquid sealing fluid would be a solvent similar to ink stored in the holding space 111, or a pigment-free base fluid that forms the base for the ink. A suitable sealing gas is a pressurized inert gas. A pressurized inert gas can be used to pressurizing the upper part of the holding space 111, which is not occupied by ink, up to a pressure slightly above atmospheric pressure. This provides a flow of sealing gas in the gap between wall section 110*b* and second tank-part 120.

Alternatively, or in addition to the above described configuration of a labyrinth seal, it is also possible to have a sealing lip 123 that straddles the gap between the first and second tank-parts 110, 120. A suitable sealing lip 123 is one made of rubber. This sealing lip 123 is on an outer peripheral side in the transitional region between the first and second tank-part 110, 120. The presence of this sealing lip 123 minimizes or prevents escape of sealing fluid that is present in the gap of the labyrinth seal. In the case of using gas as a sealing fluid, the sealing lip minimizes the escape of this gas.

In some embodiments, the separation between the first and second tank-parts 110, 120 is adjustable so as to improve the main tank's seal. Among these embodiments are those in which coupler 140 is of variable length and thus provides the ability to adjust this separation.

Figure 5:
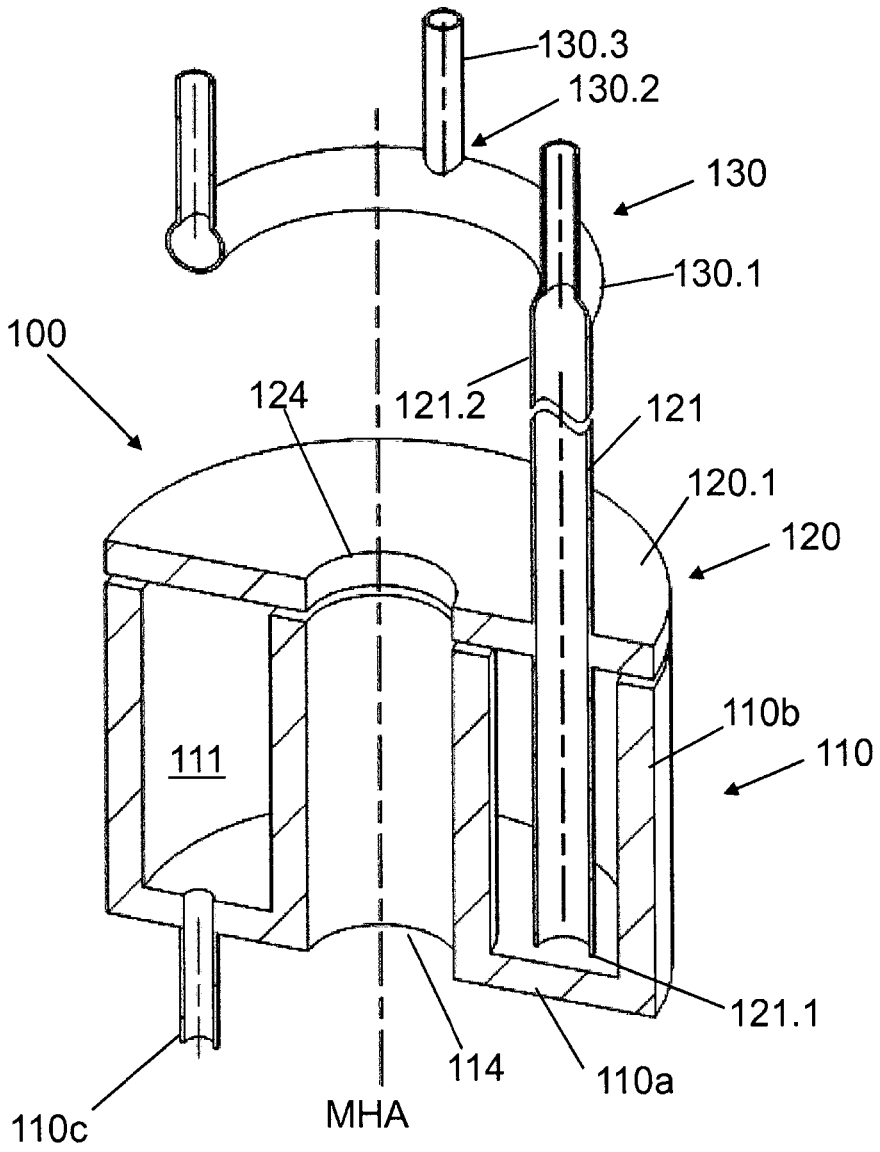
FIG. 5 shows a vertical section of the main tank of the printing system in a second embodiment.

FIG. 5 shows a further embodiment of a main tank 100 in which the first tank-part 110 defines an annulus. Apart from its feed line 110*c*, the first tank-part 110 and its annular holding space 111 are rotationally symmetric relative to median vertical axis MHA. The first tank-part 110 also defines a central first-tank-part opening 114 coaxial with the median vertical axis MHA.

An annular second tank-part 120 likewise defines a central second-tank-part opening 124 that aligns with the first-tank-part opening 114 when the second tank-part 120 is disposed on the first tank-part 110. As a result, the first-tank-part opening 114 and the second-tank-part opening 124 define a continuous opening 114, 124 through which further pipes can be passed between the static subsystem 8 and the moving subsystem 10 when the main tank 100 is arranged in the static subsystem 8 in such a way that the vertical machine axis MA coincides with the median vertical axis MHA. These further pipes can include electric pipes or fluid pipes. It is also possible to place a driver in the region of the first-tank-part opening 114 to drive the rotor 4 of the printing device 1.

In the case of the embodiment in FIG. 5, a collar-shaped distributor 130 is provided on the top of the ink pipe 121. Because the ink pipe 121 couples the distributor to the second tank-part 120, the distributor 130 is part of the moving subsystem 10.

The collar-shaped distributor 130 includes a tubular ring 130.1 that receives an upper free end 121.2 of the ink pipe 121. This results in a fluid-tight connection between an interior of the ring 130.1 and that of the ink pipe 121. Additional ink tubes 130.3 connected to the interior of the ring 130.1 form corresponding branch points 130.2 on the ring 131.1. These additional ink tubes 130.3 supply different print heads 3 with ink.

Figure 6:
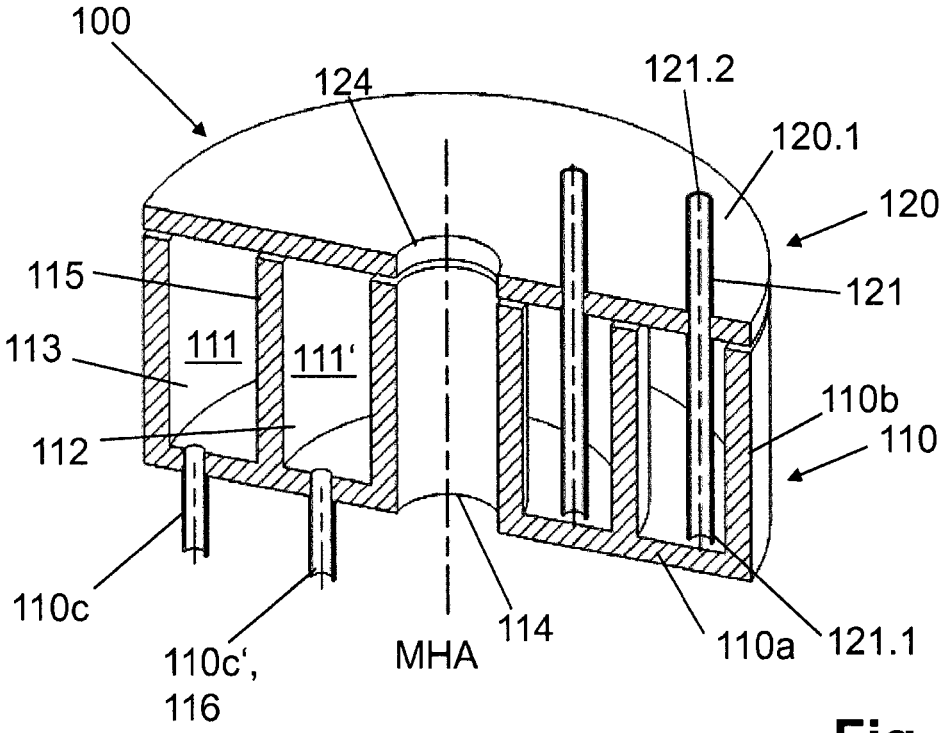
FIG. 6 shows a vertical section of the main tank of the printing system in a third embodiment.

FIG. 6 shows another annular main tank 100 similar to that shown in FIG. 5. In this embodiment, the first tank-part 110 includes a radially inner chamber 112 and a radially outer chamber 113 that are concentric with each other. The radially inner chamber 112 defines an inner annular holding space 111'. The radially outer chamber 113 defines an outer annular holding space 111. A partition 115 provides fluid-tight separation between the inner annular holding space 111' and the outer annular holding space 111.

An inner feed line 110*c*' connected to the inner annular chamber 112 provides a way to fill the inner annular chamber. Similarly, an outer feed line 110*c* connected to the outer annular chamber 113 provides a way to feed the outer annular chamber 113. Although the embodiment shown only has two chambers, it is possible to have more than two chambers arranged as shown.

Similarly, the second tank-part 120 includes inner and outer ink pipes 121 that are arranged on the cover section 120.1 such that one ink pipe 121 reaches into the inner chamber 112 and another ink pipe 121 reaches into the outer chamber 113. This permits ink in the inner chamber 112 to be withdrawn independently of ink in the outer chamber 113.

Figure 7:
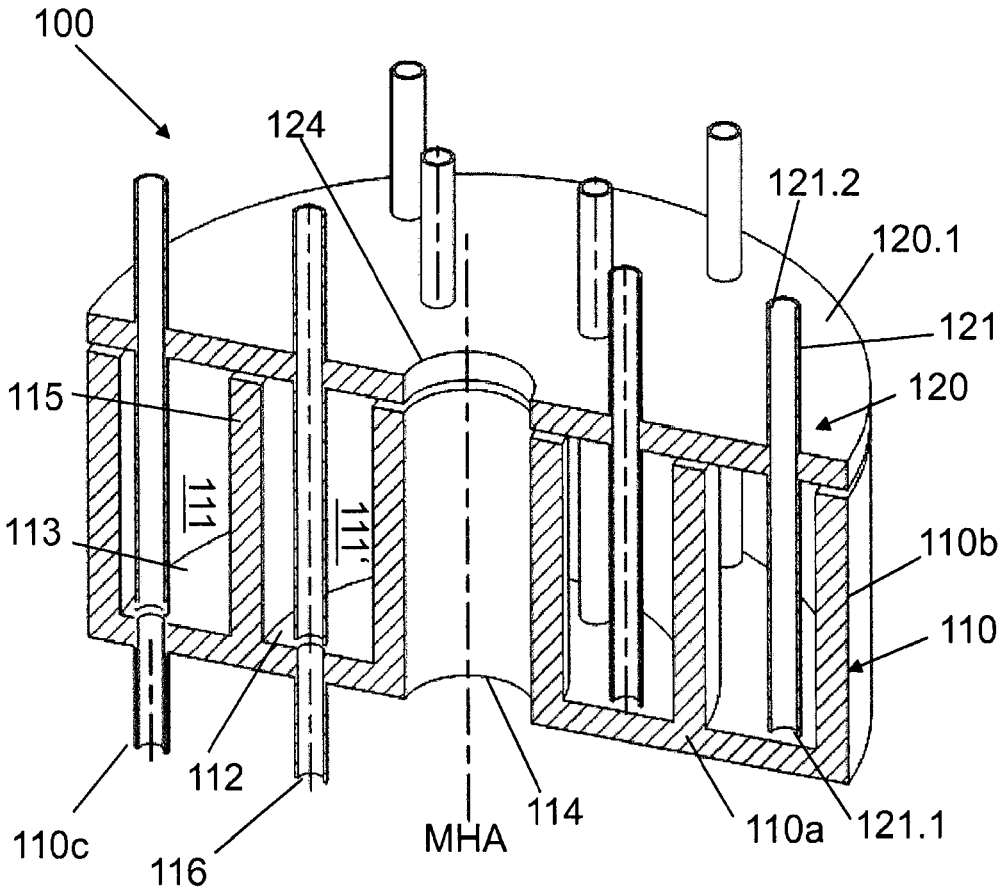
FIG. 7 shows a vertical section of the main tank of the printing system in a fourth embodiment.

FIG. 7 shows an embodiment similar to that shown in FIG. 6 but having more than one ink pipe 121 per chamber 112, 113. This permits separate print heads 3 to be fed from the same chamber 112, 113, with each print head 3 having its own associated ink pipe 121.

Figure 8:
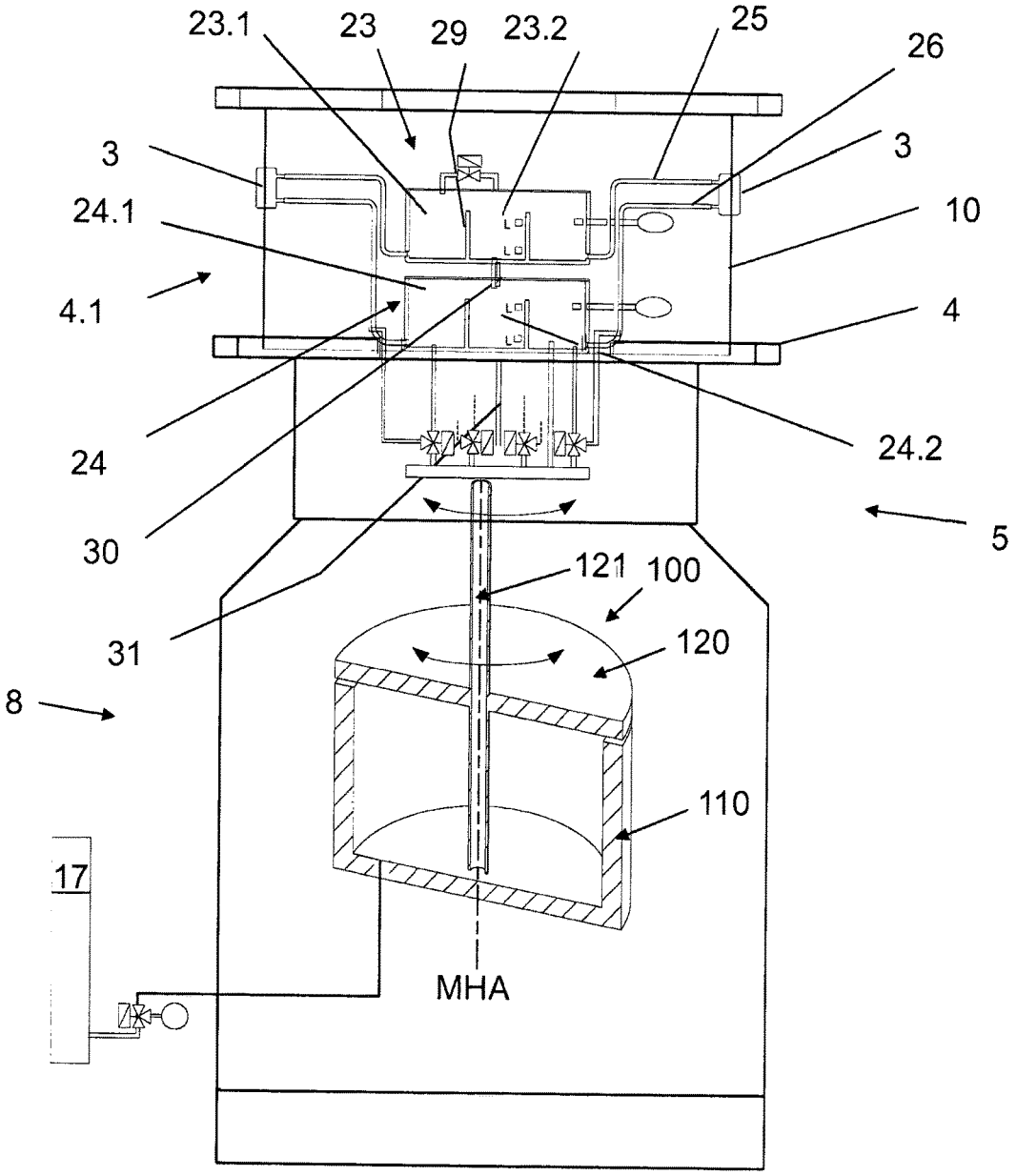
FIG. 8 shows a vertical section of the rotating and the static part of the printing system of FIG. 2, having a main tank according to FIG. 3.

Referring now to FIGS. 2 and 8, the moving subsystem 10 includes first and second auxiliary tanks 23, 24. The first auxiliary tank 23 serves as an in-tank or source for feeding ink to the print head 3. The second auxiliary tank 24 serves as an out-tank or drain to receive ink that is not needed during printing and that has flowed through print heads 3. As shown in FIG. 8, the first and second auxiliary tanks 23, 24 are concentric annular tanks coaxial with the machine axis MA and vertically superimposed on the rotor 4 with the first auxiliary tank 23 being above the second auxiliary tank 24. The individual print heads 3 are distributed about the first and second auxiliary tanks 23, 24.

The supply line 21 connects to the auxiliary tank 23 via the supply-line valve 22. The first auxiliary tank 23 connects via a printer-inlet pipe 25 to an inlet of a print head 3. An outlet of each print head 3 connects via a printer-outlet pipe 26 to a pressure reducer 27 and then on to the multiport valve 28.

The multiport valve 28 has threes settings: (1) connecting the printer-outlet pipe 26 to the second auxiliary tank 24, (2) connecting the second auxiliary tank 24 to the supply line 21, and (3) connecting the printer-outlet pipe 26 to the supply line 21. During normal printing operation, the multiport valve 28 connects the printer-outlet pipe 26 and the auxiliary tank 24 via the multiport valve 28. In the illustrated embodiment, the first and second auxiliary tanks 23, 24 are identically configured.

Each of the first and second auxiliary tanks 23, 24 includes a regulator for regulating internal tank pressure, and in particular, pressure in the printer-inlet pipe 25 and in the printer-outlet pipe 26. This permits regulating pressure the connections of print heads 3. The regulator controls this pressure such that that a first auxiliary tank pressure P23 in the first auxiliary tank 23 is somewhat greater than a second auxiliary tank pressure P24 in the second auxiliary tank 24 and also slightly less than atmospheric pressure. This pressure control ensures that ink flows through the print heads 3 during the printing operation, and that the amount of ink that is fed to each print head 3 through the printer-inlet pipe 25 but that is not required for printing flows through the print head 3 to be discharged down its printer-outlet pipe 26. The volume of ink flow to each print head 3 from the first auxiliary tank 23 and from each print head 3 to the second auxiliary tank 24 can be adjusted by appropriately selecting the first and second auxiliary tank pressures P23, P24.

To achieve conditions during printing that are essentially independent of the rotor's rotational speed: (1) the first and second auxiliary tanks 23, 24 are centered on the rotor 4; (2) the print heads 3 are all the same radial distance from the first and second auxiliary tanks 23, 24 and the printer-inlet pipes 25; and (3) the printer-outlet pipes 26 that lead to the individual print heads 3 are each mounted on the rotor 4 for all the print heads 3 in the same way so that they all run radially or essentially radially relative to the vertical machine axis MA.

The first and second auxiliary tanks 23, 24 are also equipped with a fill-level regulator that regulates the fill levels of ink in first and second auxiliary tanks 23, 24 while the printing device 1 operates.

Referring now to FIG. 8, the fill-level regulator includes first and second annular dams 29 concentric with the machine axis MA. A first dam 29 divides the first auxiliary tank 23 into a first storage compartment 23.1 for storing ink and a first collection compartment 23.2 for collecting surplus ink. Similarly, a second dam divides the second auxiliary tank 24 into a second storage compartment 24.1 for storing ink and a second collection compartment 24.2 for collecting surplus ink. As shown in FIG. 8, the first and second collection compartments 23.2, 24.2 are radially inside relative to the first and second storage compartments 23.1, 24.1 so that each of the first or second storage compartments 23.1, 24.1 encircles its corresponding first or second collection compartment 23.2, 24.2.

During operation, ink constantly overflows the dam 29 from the storage compartment 23.1, 24.1 into the collection compartment 23.2, 24.2. Both collection compartments 23.2, 24.2 connect ultimately to the main tank 100. In particular, a first overflow pipe 30 and a pressure reducer connects the first collection compartment 23.2 to the second collection compartment 24.2. Meanwhile, a second overflow pipe 31 connects the second collection compartment 23.2 to the main tank 100. An overflow control valve 34 controls flow between the second collection compartment 24.1 and the main tank 100.

While in operation, a controller controls the printing system 5 by appropriate triggering of the ink pump 15, the supply-line valve 22, the multiport valve 18 and the overflow control valve 34. When a main-tank sensor 35 detects a drop in the main tank's fill level, the controller opens the top-up valve 16 to add ink from the ink cartridge 17. This additional ink flows through the ink pump 15, the ink degasser 13, the ink filter 14, and the multi-port valve 18 before finally reaching the main tank 100.

Similarly, one or both collection compartments 23.2, 24.2 has a corresponding collection-compartment sensor 36. When the controller receives a signal from a collection-compartment sensor 36, it takes corrective action to regulate the level of ink in the corresponding collection compartment 23.2, 24.2.

A first drain valve 32 connects the first storage compartment 23.1 to the first overflow pipe 30. Similarly, a second drain valve 32 connects the second storage compartment 24.1 to the second overflow pipes 30. Both drain valves 32 remain closed during normal operation of the printing system 5.

In operation, ink circulates in first and second ink circuits. The first ink circuit lies entirely within the static subsystem 8. It includes the ink pump 15, the ink degasser 13, the ink filter 14 and the main tank 100.

The second ink circuit spans both subsystems. In the second ink circuit, ink from the first auxiliary tank 23 flows through the print head 3. Any surplus ink passes via the multiport valve 28 back to the second auxiliary tank 24, and eventually over the dam 19, into the second collecting space 24.2, and back to the main tank 100. Eventually, the ink pump 15 will send this ink back up to the first auxiliary tank 23 to start the cycle once again.

During this cycle, ink repeatedly passes through the temperature-controlled main tank 100, the ink degasser 13 and the ink filter 14. As such, the ink is constantly being conditioned and is therefore always at a level of quality and temperature that is necessary for optimum printing.

In some embodiments, the controller controls the printing system 5 so that ink flows through both ink circuits simultaneously during the printing operation. However the controller can also cause only the second ink circuit, which incorporates the static subsystem 8 and the moving subsystem 10, to be activated. This is useful for a faster, more intensive conditioning of the ink at a time when no additional ink has to be supplied to the first auxiliary tank 23.

The two-part configuration of the printing system 5, i.e. its separation into a static subsystem 8 and moving subsystem 10, offers significant advantages.

A first advantage is that the ink pump 15 and all functional elements required for conditioning the ink can be accommodated in the static subsystem 8. This reduces the number of components on rotor 4 and thus the overall volume used up in the rotor 4.

A second advantage is mechanical isolation. The mechanical vibrations caused by the ink pump 15 and by other motorized functional elements in the static subsystem 8 are separated from the print heads 3. As a result, these vibrations cannot impair print quality.

A third advantage is that the printing system 5 can be easily topped up with fresh ink from an ink cartridge 17 through the top-up valve 16. This newly-introduced ink is then pretreated in the ink degasser 13 and in the ink filter 14 before being placed into circulation.

The use of the two auxiliary tanks 23, 24 that are arranged centrally on rotor 4 and that are rotationally symmetrical relative to the vertical machine axis facilitates a homogeneous pressure distribution in the ink at the connections the print heads 3.

By regulating the first and second auxiliary tank pressures P23, P24, and taking into consideration the arrangement of print heads 3 relative to auxiliary tanks 23, 24 and as a function of the rotational speed of the rotor, it is possible to control and/or regulate both the pressure of the ink at the print heads 3 and/or at nozzles 3.1 and the flow rate of the ink through print heads 3.

The use of first and second auxiliary tanks 23, 24 isolates the print heads 3 from possible pressure fluctuations or pressure surges that may occur during the feeding and/or discharging of ink. This eliminates adverse effects on the quality of the printed image that may be caused by such pressure fluctuations.

Regulating the level of ink in the first and second storage compartments 23.1, 24.1 provides constant pressure conditions at the connections of the print heads 3. This leads to a repeatable optimum print quality. The constant circulation of ink also avoids having any ink dry out, thus avoiding malfunctions associated with the presence of dry ink.

In order to achieve conditions that are independent of the rotor's rotational speed the first and second overflow pipes 30, 31 and their connections are arranged coaxially with the machine axis MA. In addition, the first and second auxiliary tanks 23, 24 form storage compartments 23.1, 24.1 that lie radially outward relative to the machine axis MA and collecting spaces 23.2, 24.2 that lie on the inside relative to machine axis MA.

In addition to operating in printing mode, the printing system 5 can also operate in maintenance mode to flush and clean print heads 3 and/or nozzles 3.1. For this purpose, the controller causes the ink to be pumped or to flow at increased pressure through the print heads 3 from the static subsystem 8 to the moving subsystem 10 and through the printer-inlet pipes 25 to the individual print heads 3. This highly pressurized ink emerges from the nozzles 3.1 and thus flushes them clean.

Figure 9:
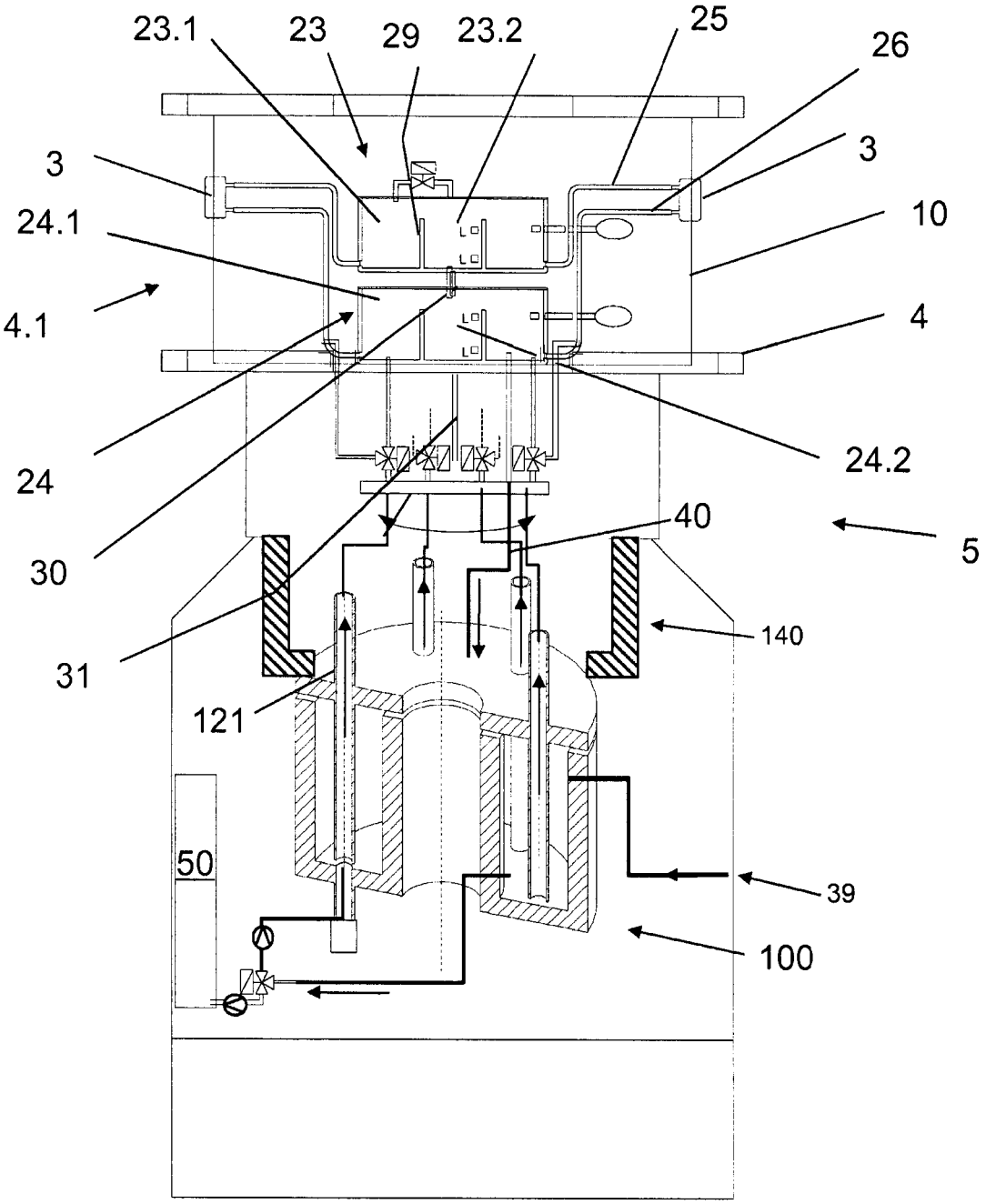
FIG. 9 shows a vertical section of the rotating and the static part of the printing system of FIG. 2 having a main tank similar to that shown in FIG. 5.

FIG. 9 shows, in a view comparable to that shown in FIG. 8, an annular main tank 100 that accommodates a plurality of ink pipes 121 for feeding ink. The ink pipes 121 connect to an in-tank 23 that provides ink to be fed to the print heads 3. A return pipe 40 leads from an out-tank 24 back to the main tank 100 so that ink that was not used during printing can be returned for conditioning.

A coupler 140 permanently connects the second tank-part 120 to the rotor 4. As a result, when the rotor 4 rotates, the second tank-part 120 also rotates.

An inert gas feed line 39 feeds an inert gas into a holding space 111 of the main tank 100. This inert gas can be used to generate a flow of sealing air that escapes through a gap provided between first and second tank-parts 110, 120 so as to prevent unwanted substances entering holding space 111.

Figure 10:
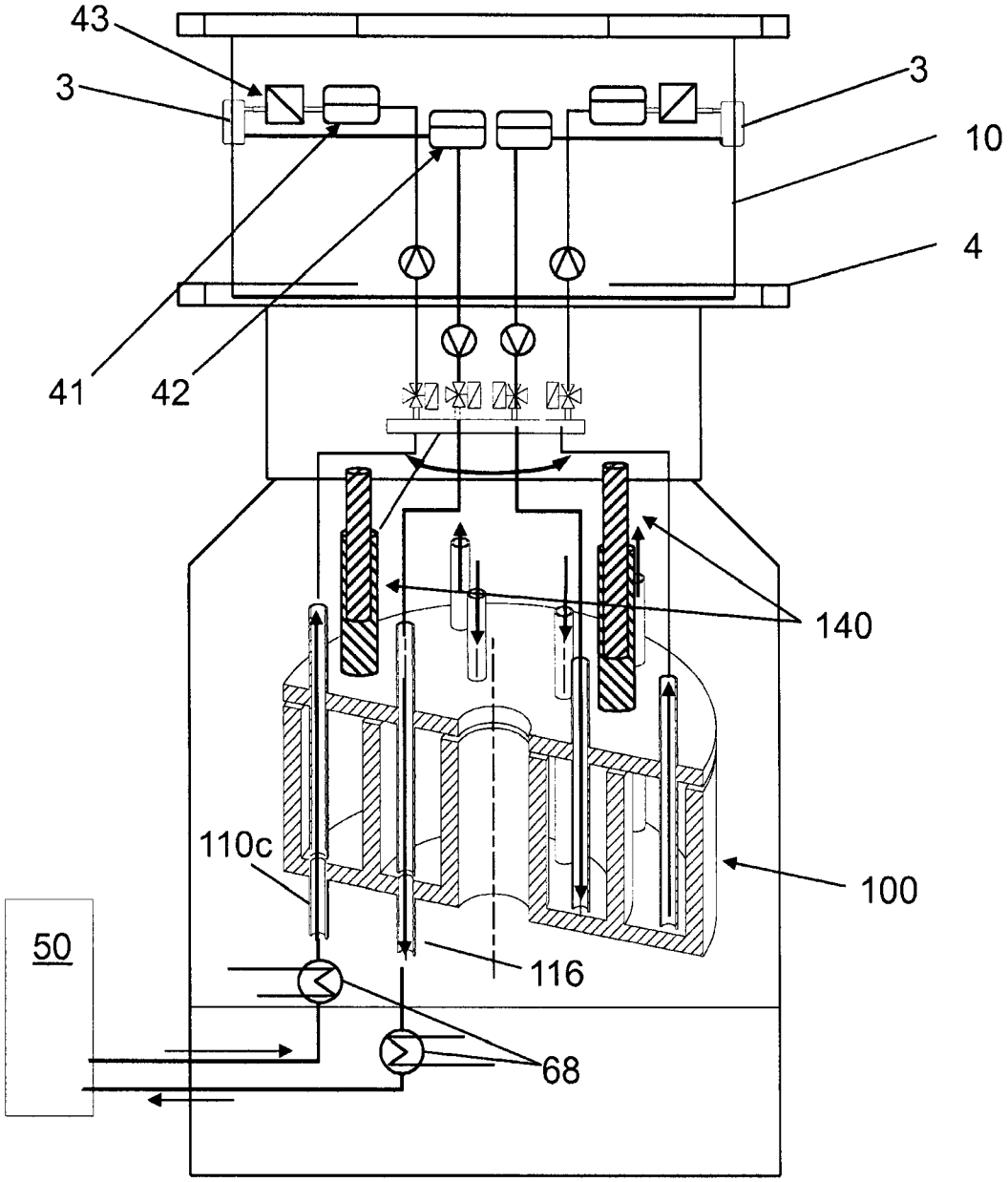
FIG. 10 shows a simplified view and vertical section of the rotating and the static part of the printing system of FIG. 2, having a main tank similar to FIG. 7.

FIG. 10 shows a further embodiment of the printing system 5 that makes use of the main tank 100 described in connection with FIG. 7.

Referring to FIG. 7, the main tank has first and second chambers 112, 113, with the second chamber 113 encircling the first chamber 112 and forming a feed chamber in which conditioned or temperature-balanced ink is stored. Ink pipes 121 extending into the second chamber 113 supply print heads 3 with ink. Ink pipes 121 extending into the first chamber 112 return ink to the first chamber 112 so that it can be reconditioned.

The first chamber 112 connects, via a discharge pipe 116, to a reconditioner 50 that reconditions ink. The reconditioner 50 does so by degassing, filtering, and other conditioning operations. A first temperature regulator 68 in the discharge pipe 116 cools the ink on its way to the reconditioner 50. The reconditioning apparatus 50 returns the reconditioned ink to the second chamber 113 via a feed pipe 110*c*. A second temperature regulator 68 in the feed pipe 110*c* heats the ink before it reaches the second chamber 113.

A coupler 140 provides a permanent mechanical coupling of the second tank-part 120 with the rotor 4 so that, when rotor 4 rotates, the second tank-part 120 also rotates. The coupler 140 is height-adjustable. As a result, it is possible to mount the second tank-part 120 at different heights relative to the rotor 4.

Instead of first and second auxiliary tanks 23, 24, the embodiment of FIG. 10 uses first and second pulsation dampers 41, 42. Each pair of first and second pulsation dampers 41, 42 is associated with a print head 3. The first pulsation damper 41 lies upstream of the print head 3 and the second pulsation damper 42 lies downstream of the print head 3. The first and second pulsation dampers 41, 42 provide some storage space for ink, although this storage space is considerably smaller than that provided by the first and second auxiliary tanks 23, 24.

In some embodiments, the first and second pulsation dampers 41, 42 have a diaphragm that divides the interior of the pulsation damper 41, 42 into first and second spaces. Ink flows through the first space, while the second space contains gas. These pulsation dampers 41, 42 provide a way to minimize pressure fluctuations in the pipe system that feeds and discharges ink. A filter 43 in the ink path, preferably between the first pulsation damper 41 and the print head 3, filters any particles larger than a predefined size.

Figure 11:
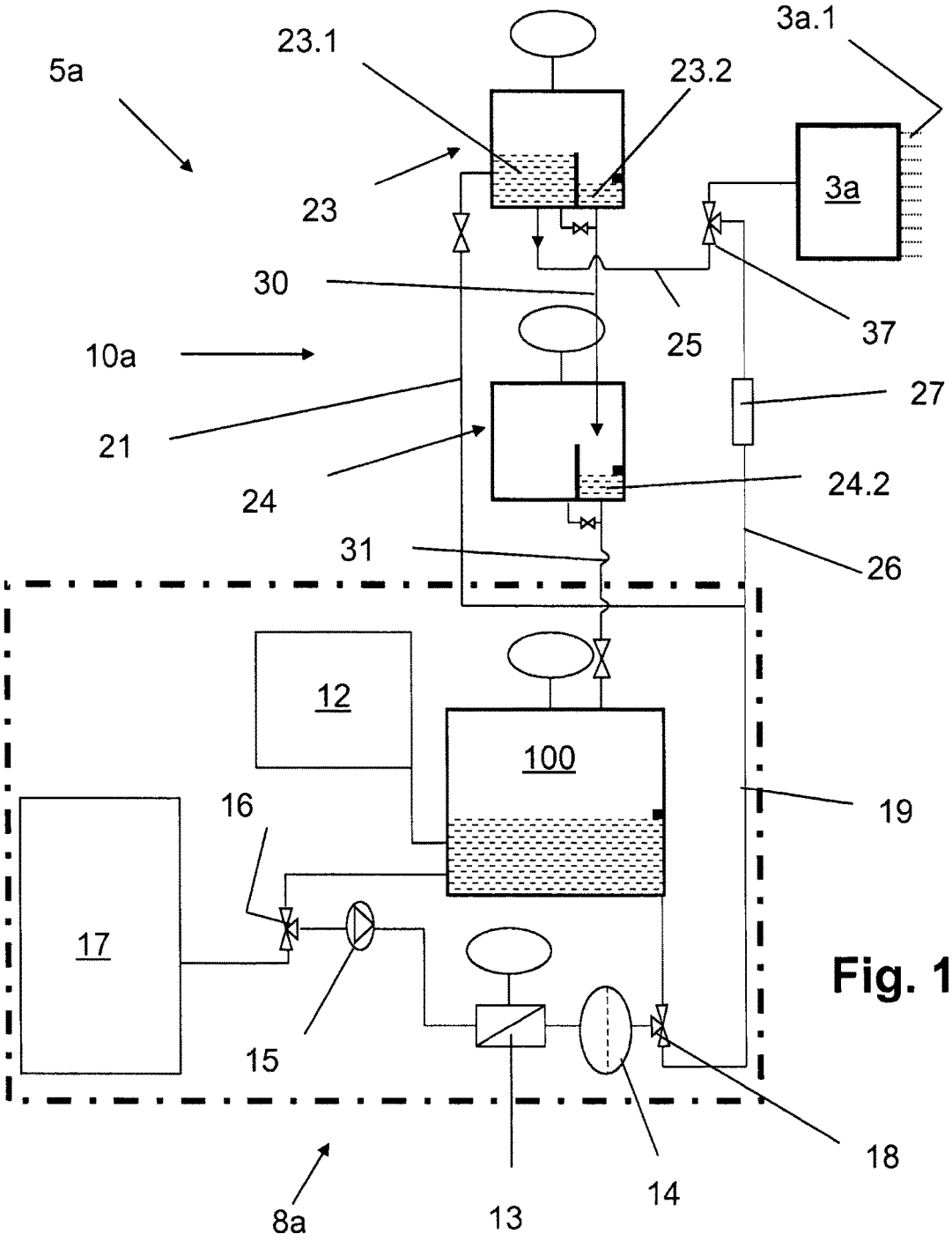
FIG. 11 shows in a depiction similar to FIG. 2 a further embodiment of the printing system.

FIG. 11 shows an alternative printing system 5*a* having a static subsystem 8*a* and a moving subsystem 10*a*, with the static subsystem 8*a* being identical to the static subsystem 8 of the printing system 5 shown in FIG. 2. On the rotor that can be driven to rotate about a vertical machine axis MA, the moving subsystem 10*a* includes digital electrically operable inkjet print heads 3*a*, each of which comprise a plurality of nozzles 3*a*.1 for the controlled delivery of the ink. The nozzles are provided sequentially along an axis that is parallel to machine axis MA.

Unlike the print heads 3 shown in FIG. 2, the print heads 3*a* shown in FIG. 11 are "end-shooter" print heads. Such print heads have a static ink supply and only one connection through which the ink is fed at a predetermined pressure, for example at a slight negative or positive pressure.

The moving subsystem 10*a* of the printing system 5 again includes the first and second auxiliary tanks 23, 24. However, only the first auxiliary tank 23 connects to the print head 3*a*. In particular, a printer-inlet pipe 25 having a multiport valve 37 connects the first storage compartment 23.1 to the single input of each print head 3*a*. Also connected to the multiport valve 37 is a printer-outlet pipe 26 with a pressure reducer 27. This printer-outlet pipe 26 connects directly to the supply line 21.

In the alternative printing system 5*a*, the second auxiliary tank 24 does not act as a drain to receive ink that is returned by the print heads 3. Instead, the second auxiliary tank 24, and in particular, the second collection compartment 24.2 thereof, only receives surplus ink from the first collection compartment 23.2 and passes it on to the main tank 100 of the static subsystem 8*a*.

Two ink circuits are also possible in the alternative printing system 5*a*. A first circuit within the static subsystem 8*a* includes the ink pump 15, the ink degasser 13, the ink filter 14, and the main tank 100. A second ink circuit includes the static subsystem 8*a* as well as the moving subsystem 10*a*. Ink that starts at the storage compartment 23.1 of the first auxiliary tank 23, the second ink circuit overflows a dam 19 and lands in the first collection compartment 23.2. From there, it proceeds to the second collection compartment 24.2 and ultimately, to the main tank 100. The ink leaves the main tank 100 via the ink pump 15. It passes through the ink degasser 13, the ink filter 14, and the supply line 21 back to the first auxiliary tank 23, and in particular, to the storage compartment 23.1 of the first auxiliary tank 23.

It is apparent that the ink is continuously being conditioned by passing through the ink degasser 13 and the ink filter 14 as well as by having its temperature adjusted. This occurs not only for ink in the static subsystem 8*a*, but also for ink flowing through the second circuit, which includes both the static subsystem 8*a* and the moving subsystem 10*a* of the printing system 5*a*.

Figure 12:
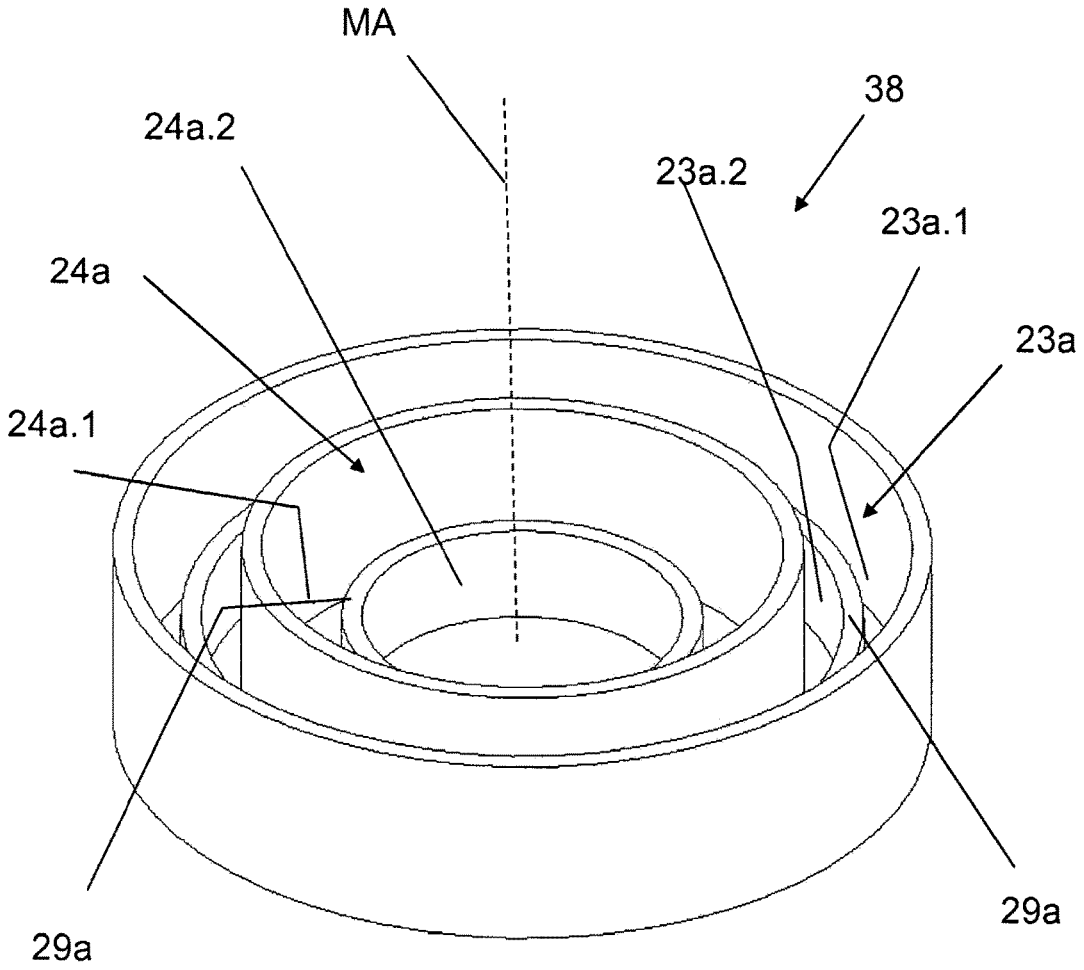
FIG. 12 shows a perspective single view of the in-tank or out-tank of the printing system.

In the configurations disclosed thus far, identical annular first and second auxiliary tanks 23, 24 are arranged vertically offset relative to one another along the machine axis. However, other configurations are possible. In particular, FIG. 12 shows a perspective view of a tank arrangement 38 that forms annular first and second auxiliary tanks 23*a*, 24*a* that are not arranged offset relative to one another in the direction of machine axis MA. Instead the first and second auxiliary tanks 23*a*, 24*a* are arranged in such a way that the first auxiliary tank 23*a* surrounds the second auxiliary tank 24*a* like a ring. Respective annular dams 29*a* separate the first and second auxiliary tanks 23*a*, 24*a* into storage compartments 23*a*.1, 24*a*.1 and collection compartments 23*a*.2, 24*a*.2.

Figure 13:
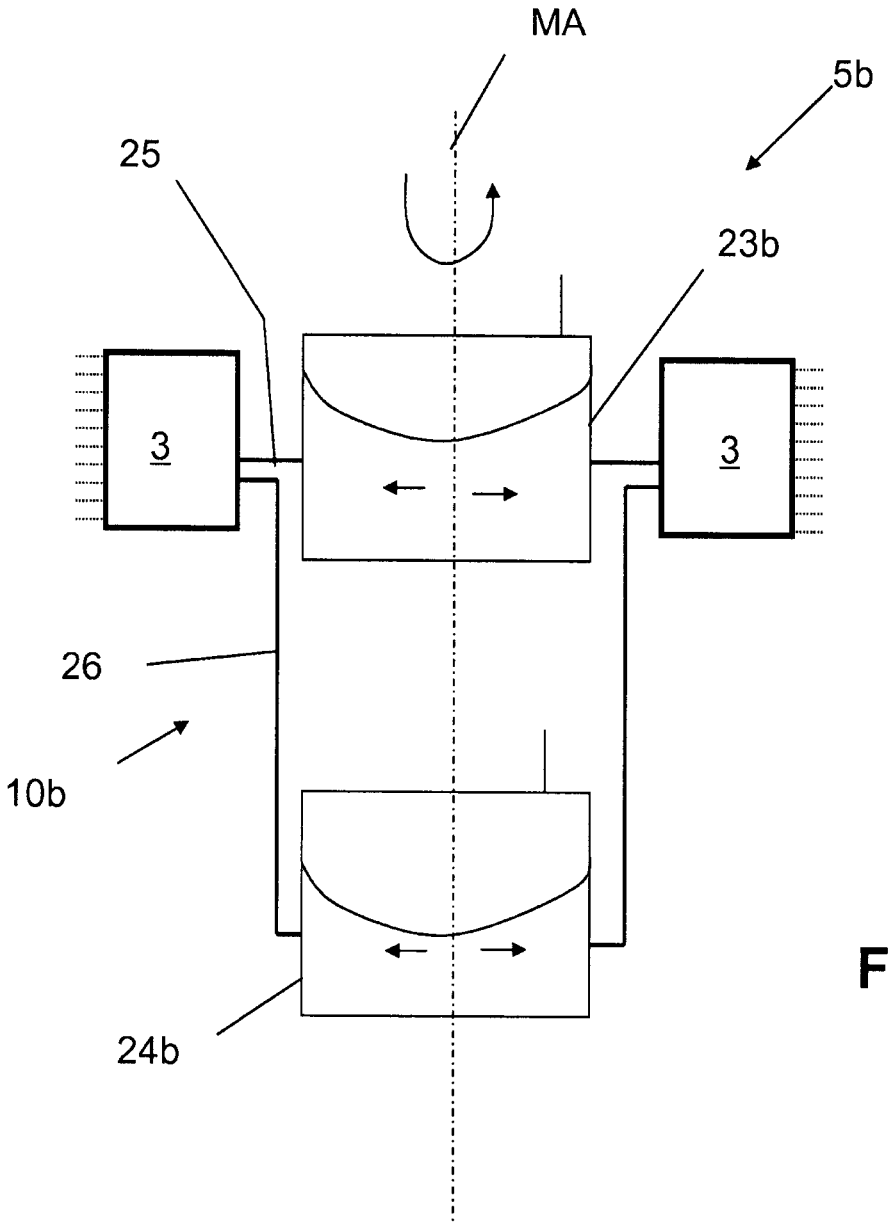
FIG. 13 shows the in-tank and out-tank of the rotating part of a printing system together with two print heads of that system.

FIG. 13 again shows a moving subsystem 10*b* of a printing system 5*b* that includes print heads 3, together with first and second auxiliary tanks 23*b*, 24*b* that are arranged centrally and offset relative to one another in the direction of machine axis MA. In this embodiment, the first auxiliary tank 23*b* is the ink source or in-tank for the print heads 3, and the second auxiliary tank 24*b* forms the ink drain or out-tank for the print heads 3. For the sake of clarity, FIG. 13 shows only two print heads 3. In fact the printing system 5*b* can include many more print heads 3.

Although the two auxiliary tanks 23*b* and 24*b* are arranged centrally relative to the machine axis MA and configured so as to be rotationally symmetric, i.e. in the shape of a circular cylinder, about the machine axis MA, there is neither a dam 29 nor a collection compartment.

Rotation of the rotor causes a convex meniscus in the ink's surface, as shown in FIG. 13.

Changes in pressure conditions due to a changing rotational speed of the rotor are adapted and/or compensated by regulating pressures P23*b* and P24*b* in the auxiliary tanks 23*b*, 24*b*, and hence the pressure differential between these auxiliary tanks, so as to achieve a constant rate of flow of the ink through the print heads 3 as well as a constant pressure, for example a constant meniscus vacuum, at the nozzles 3.1 of the print heads 3.

In the embodiments described thus far, the printing device 1 includes a printing system 5, 5*a*, 5*b* that prints containers 2 with a single ink having a single color. One way to produce multicolor prints is to provide a sequence of printing devices 1, each of which prints one color. To assist with aligning containers in printing devices 1 that follow the first printing device 1, it is useful for the printing positions 4.1 to align a received container using a marking that is has been formed on the container or that has been applied to the container before printing actually begins. This will promote the correct application of the individual colors relative to each other.

An alternative is to provide, on a single printing device 1, a plurality of printing systems 5, 5*a*, 5*b* for a corresponding plurality of different inks in different colors so that one can print a multicolored image on a container.

Figure 14:
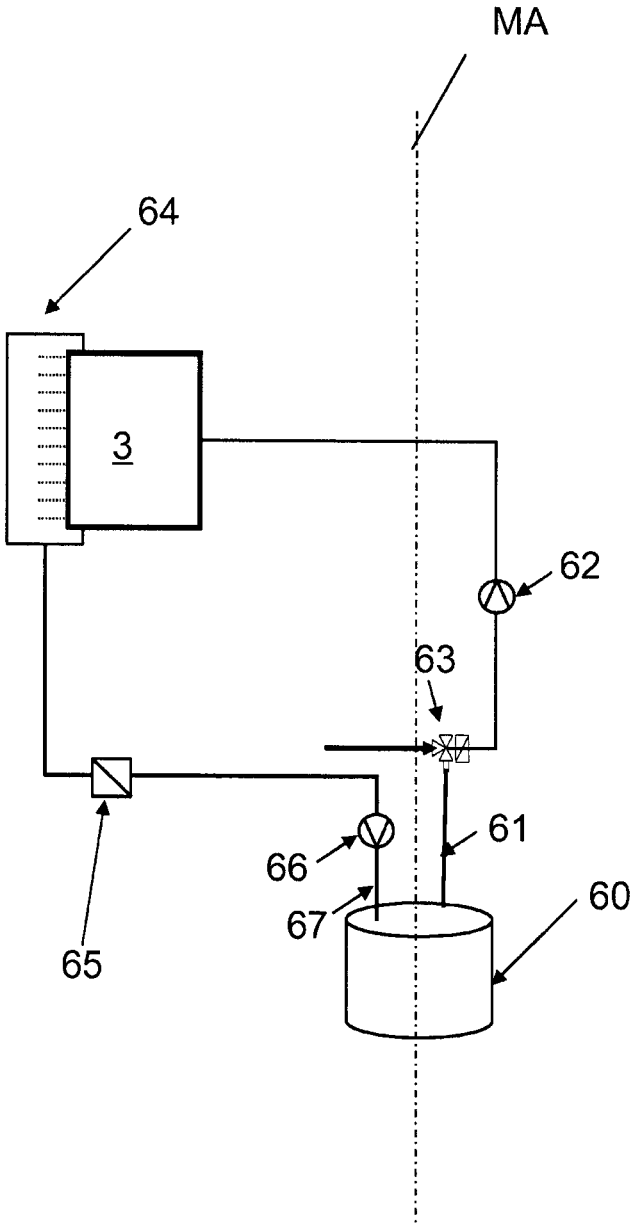
FIG. 14 shows a schematic view of a cleaning system for cleaning a print head.

FIG. 14 shows an end-shooter print head 3. In an end-shooter print head 3, there is no ink circuit into which the print head 3 is integrated, as was the case in the embodiments shown in FIGS. 2, 8, 9, 10, and 13. Instead, pressurized ink is continuously present at the print head with no way to leave other than through the nozzles 3.1. A cross flow of ink through a rear chamber of the print heads 3, i.e. a flow running at right angles to the individual channels in the respective nozzles 3.1, is therefore not possible.

Regardless of the type of print head, the printing system 5 can also include a cleaning subsystem for cleaning the print heads 3. Such a system includes a cleaning fluid tank 60 that contains cleaning fluid. A suitable cleaning fluid is one that includes a solvent, or an ink base but with no pigments or UV-reactive constituents or inhibitors.

A cleaning fluid pipe 61 connects the holding space of the cleaning fluid tank 60 to a print head 3, and preferably to all print heads 3 of the printing system 5. This cleaning fluid pipe 61 preferably incorporates a first cleaning fluid pump 62 and a cleaning fluid multiport valve 63 through which a gaseous cleaning medium can be introduced into cleaning fluid pipe 61 instead of a liquid cleaning medium.

A cover cap 64 defines a discharge region in front of the print head 3 and into the print head 3 discharges cleaning fluid. The cover cap 64 receives the cleaning fluid as it emerges from the print head's nozzles 3.1 so that it can then flow into a cleaning fluid return pipe 67 from the cover cap 64 and back to the cleaning fluid tank 60. On its way, the cleaning fluid passes through a cleaning fluid filter unit 65 and a second cleaning fluid pump 66. A conditioning unit for conditioning the cleaning fluid may also be provided in the circuit.

Because of the cleaning circuit, it is possible to apply the cleaning fluid to individual print heads 3 of printing system 5 and to deliver the cleaning fluid through nozzles 3.1 so as to flush residual ink out of the print head 3. After the nozzles 3.1 discharge cleaning fluid, the cover cap 64 collects it and delivers it back to the cleaning fluid tank 60 to be re-used after having been filtered by the cleaning filter unit 65 and after having been conditioned.

The cleaning fluid tank 60 can be a separate tank that is part of the static subsystem 8. Alternatively, the cleaning fluid tank 60 can be integral to the main tank 100 such that a chamber 112, 113 of the main tank 100 receives the cleaning fluid.

If a separate cleaning fluid tank 60 is used, then the cleaning process can be carried out with the rotor 4 at rest so as to facilitate a fixed connection that is to be made for the cleaning process between the static subsystem 8 and the moving subsystem 10. Alternatively a separate rotary distributor can be used to make a connection between the static subsystem 8 and the moving subsystem 10. A separate rotary distributor is not required if the cleaning fluid tank 60 is incorporated into the main tank 100 because the coupling of the moving subsystem 10 to the static subsystem 8 already exists as a result of the main tank 100 having an entrained second tank-part 120.

Thus the invention provides a simple way to keep printing inks in circulation. This is useful because printing inks tend to disassociate. This continuous circulation results from constantly stirring and mixing the tank's contents with the free ends of the withdrawal pipes 121 that extend into the first tank-part 110 and that move together with the second tank-part 120. In order to avoid an unwanted absorption and solution of gases in the ink, a buffer gas, in particular an inert gas or sterile gas, can be introduced from time to time or continuously into a head space of the main tank 100. This gas can be introduced through a passageway in the wall of the first tank-part 110. As a result of the stirring action, there is no need for an external pump to provide circulation.

In the embodiments described above, the moving subsystem 10, 10*a*, 10*b* is above the static subsystem 8, 8*a*. However, it is also possible to configure the static subsystem 8, 8*a* so that it encloses, or almost encloses, the moving subsystem 10, 10*a*, 10*b*. In such cases, only the print heads protrude above the top of the printing system 5. This results in a compact design.

It was moreover assumed above that the print heads 3 3*a* are also provided on the rotor 4 that forms the container transporter. As a result, the rotor 4 moves both the containers and the print heads 3, 3*a*. However, in embodiments with multiple print heads 3, 3*a*, each corresponding to a different color of a multicolor print, each color's print heads are provided on their own dedicated print-head transport element that moves or rotates about the vertical machine axis MA.

In particular, in some examples, the first and second auxiliary tank pressures P23, P24 are regulated as a function of the rotational speed and/or acceleration of the rotor 4. In these embodiments, the pressure regulation compensates for the action of centrifugal forces on the ink.

The invention has been described hereinbefore by reference to embodiments. It goes without saying that numerous variations as well as modifications are possible without departing from the inventive concept underlying the invention.

The invention claimed is:

1. An apparatus comprising a printing system for printing on containers, said printing system comprises a moving subsystem, a static subsystem, a print head, a printing station, and a tank, wherein said print head is disposed on said moving subsystem, said print head comprises a digital ink jet print head, said print head is a constituent of said printing station, and said printing station is disposed on said moving subsystem, wherein said printing station is configured to move along a transport path for said containers, wherein said static subsystem is not entrained with said print head, wherein said tank is a constituent of said static subsystem, said tank holds ink to be supplied to said print head, and said tank comprises a first tank-part, and a second tank-part, wherein said first tank-part is static, said first tank-part comprises a lower tank part that defines a holding space for holding said ink, and wherein said second tank-part is configured for entrainment with said moving subsystem.

2. The apparatus of claim 1, said second tank-part comprises an upper tank-part that closes off said first tank-part.

3. The apparatus of claim 1, said second tank-part comprises a cover that closes off said first tank-part.

4. The apparatus of claim 1, further comprising a fluid-tight connection between said first tank-part and said second tank-part.

5. The apparatus of claim 1, further comprising a ring seal that forms a fluid-tight connection between said first tank-part and said second tank-part.

6. The apparatus of claim 1, further comprising a sliding seal that forms a fluid-tight connection between said first and second tank-parts.

7. The apparatus of claim 1, further comprising a gap seal that forms a fluid-tight connection between said first and second tank-parts.

8. The apparatus of claim 1, further comprising a fluid-filled gap seal that forms a fluid-tight connection between said first and second tank-parts.

9. The apparatus claim 1, further comprising a gap between said first and second tank-parts, inert gas disposed in an interior of said tank, and a flow of inert seal gas through said gap.

10. The apparatus of claim 1, wherein said second tank-part is configured to be height-adjustable relative to said first tank-part.

11. The apparatus of claim 1, further comprising walls defining a first opening and walls defining a second opening, wherein said first tank-part is annular, wherein said second tank-part is annular, wherein said first tank-part defines said walls defining said first opening and wherein said second tank-part defines said walls defining said second opening.

12. The apparatus of claim 1, further comprising an ink pipe having a free end, wherein said ink pipe extends through said second tank-part into a holding space formed by said first tank-part, wherein said free end is disposed inside said holding space.

13. The apparatus of claim 1, further comprising a first ink pipe having a free end, and a second ink pipe having a free end, wherein said first ink pipe extends through said second tank-part into a first holding space formed by a first chamber in said tank, and wherein said second ink pipe extends through said second tank-part into a second holding space formed by a second chamber in said tank.

14. The apparatus of claim 1, further comprising a first ink pipe having a free end, and a second ink pipe having a free end, wherein said first ink pipe extends through said second tank-part into a holding space in said tank, and wherein said second ink pipe extends through said second tank-part into said holding space.

15. The apparatus of claim 1, further comprising an ink pipe and a stirring section, wherein said ink pipe comprises a free end, wherein said ink pipe extends through said second tank-part into a holding space formed by said first tank-part, wherein said free end is disposed inside said holding space, and wherein said stirring section protrudes laterally from said free end.

16. The apparatus of claim 1, wherein said second tank-part further comprises a stirring section that extends into a holding space within said first tank-part.

17. The apparatus of claim 1, wherein said first tank-part comprises separate chambers, each of which is configured to separately hold a volume of ink.

18. The apparatus of claim 1, further comprising a container transporter that is driven to rotate about an axis thereof, wherein said printing station, along with a plurality of other printing stations, is formed on said container transporter, wherein said other printing stations each comprise at least one inkjet print head.

19. A method of using a printing system for stirring ink during printing of containers, said method comprising steps of causing containers to be moved by a rotationally driven container transporter having a plurality of printing stations formed thereon, each of said printing stations having an inkjet print head, holding ink in a first tank for at least a majority of said print heads, wherein said tank comprises a static first tank-part and a moving second tank-part, extending a pipe through said second tank part and into said first tank part such that said pipe is at least partially in said ink, said pipe being connected to said second tank part, whereby said pipe, as a result of movement imparted by connection to said second tank part, stirs said ink.

20. The method of claim 19, further comprising entraining said second tank-part with a moving printing system, and holding ink in a holding space formed in said first tank-part.

21. The method of claim 19, further comprising placing said digital ink jet print head on a moving subsystem, moving said print head along a transport path for said containers, providing a static subsystem that is not entrained with said print head, and placing ink for use by said print head in a tank defined by said static subsystem, said tank comprising a static first tank-part that defines a holding space for holding said ink and a second tank-part configured for entrainment with said moving subsystem.

* * * * *